US012624862B2

(12) United States Patent
Kouno et al.

(10) Patent No.: US 12,624,862 B2
(45) Date of Patent: May 12, 2026

(54) HOT WATER SUPPLY APPARATUS

(71) Applicant: DAIKIN INDUSTRIES, LTD., Osaka (JP)

(72) Inventors: Yasuhiro Kouno, Osaka (JP); Hideho Sakaguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/181,826

(22) Filed: Mar. 10, 2023

(65) Prior Publication Data

US 2023/0228458 A1 Jul. 20, 2023

Related U.S. Application Data

(63) Continuation of application No. PCT/JP2021/035326, filed on Sep. 27, 2021.

(30) Foreign Application Priority Data

Sep. 30, 2020 (JP) ..... 2020-165038

(51) Int. Cl.
*F24H 15/225* (2022.01)
*F24H 4/04* (2006.01)

(52) U.S. Cl.
CPC ..... *F24H 15/225* (2022.01); *F24H 4/04* (2013.01)

(58) Field of Classification Search
CPC ..... F24H 15/225; F24H 4/04; F24H 15/32; F24H 15/429
See application file for complete search history.

(56) References Cited

U.S. PATENT DOCUMENTS

2011/0139259 A1* 6/2011 Nagata ..... F24D 17/02 122/13.01
2017/0023263 A1* 1/2017 Tamaki ..... F24D 19/1069

FOREIGN PATENT DOCUMENTS

| | | | |
|---|---|---|---|
| JP | 2006071176 A | * | 3/2006 |
| JP | 2008267658 A | * | 11/2008 |
| JP | 2009210205 A | * | 9/2009 |
| JP | 2012-225580 A | | 11/2012 |
| JP | 5585358 B2 | | 9/2014 |
| WO | WO 2016/001980 A1 | | 1/2016 |

OTHER PUBLICATIONS

English translaiton of JP-2009210205-A, dated Mar. 8, 2024 (Year: 2024).*
English translaiton of JP-2006071176-A, dated Mar. 8, 2024 (Year: 2024).*
English translaiton of JP-2008267658-A, dated Jul. 11, 2025 (Year: 2025).*

(Continued)

*Primary Examiner* — Michael G Hoang
*Assistant Examiner* — Brett P. Mallon
(74) *Attorney, Agent, or Firm* — Birch, Stewart, Kolasch & Birch, LLP

(57) ABSTRACT

A hot water supply apparatus includes: a first channel configured to send water in a medium-temperature layer (M) to a heating section; and a second channel configured to return water heated by the heating section to a tank. The second channel has an outflow port at a lower position than an inflow port of the first channel.

8 Claims, 6 Drawing Sheets

(56) References Cited

OTHER PUBLICATIONS

English translation of the International Preliminary Report on Patentability and Written Opinion of the International Searching Authority for International Application No. PCT/JP2021/035326, dated Apr. 13, 2023.
International Search Report (PCT/ISA/210) issued in PCT/JP2021/035326, dated Nov. 9, 2021.
Extended European Search Report issued Jan. 3, 2024 in PCT/JP2021/035326.

* cited by examiner

FIRST PREPARATION OPERATION

SECOND PREPARATION OPERATION

HOT WATER SUPPLY APPARATUS

CROSS REFERENCE TO RELATED APPLICATIONS

This application is a Continuation of PCT International Application No. PCT/JP2021/035326, filed on Sep. 27, 2021, which claims priority under 35 U.S.C. 119 (a) to Patent Application No. 2020-165038, filed in Japan on Sep. 30, 2020, all of which are hereby expressly incorporated by reference into the present application.

TECHNICAL FIELD

The present disclosure relates to a hot water supply apparatus.

BACKGROUND ART

A hot water supply apparatus that generates hot water using a heating section and supplies the generated hot water from a tank to a target has been known.

Patent Document 1 discloses a hot water supply apparatus configured to form a low-temperature layer, a medium-temperature layer, and a high-temperature layer in a tank. The hot water supply apparatus executes an operation of heating the water in the low-temperature layer, using the heating section, and then returning the water to the medium-temperature layer, and an operation of heating the water in the medium-temperature layer, using the heating section, and then returning the water to the high-temperature layer. As a result of these operations, the low-temperature layer, the medium-temperature layer, and the high-temperature layer are formed in the tank from a lower end portion to an upper end portion of the tank (see FIG. 7 of the document). Accordingly, this tank has less heat dissipation loss than a tank forming only a high-temperature layer.

CITATION LIST

Patent Document

Patent Document 1: WO 2016/001980

SUMMARY

A hot water supply apparatus according to a first aspect includes: a heating section (13) configured to heat water; and a tank (30) configured to store the water heated by the heating section (13), the hot water supply apparatus being configured to form a low-temperature layer (L), a medium-temperature layer (M), and a high-temperature layer (H) from a lower end to an upper end of the tank (30), the hot water supply apparatus including: a first channel (41) configured to send water in the medium-temperature layer (M) to the heating section (13); and a second channel (42) configured to return the water heated by the heating section (13) to the tank (30), the second channel (42) having an outflow port (42*a*) at a lower position than an inflow port (41*a*) of the first channel (41).

DESCRIPTION OF EMBODIMENT

An embodiment of the present disclosure will be described below with reference to the drawings. The embodiment described below is merely an exemplary one in nature, and is not intended to limit the scope, applications, or use of the invention.

Embodiment

A hot water supply apparatus (20) according to the present disclosure will be described.

<General Configuration>

The hot water supply apparatus (20) of the present disclosure is applied to a hot water supply unit (1). The hot water supply unit (1) heats water supplied from a water source, and stores the heated water (hot water) in a tank (30). The water source is a channel through which water is supplied, and includes a water supply system. The hot water in the tank (30) is supplied to a predetermined target. The target includes a shower, a faucet, and a bathtub.

Figure 1:
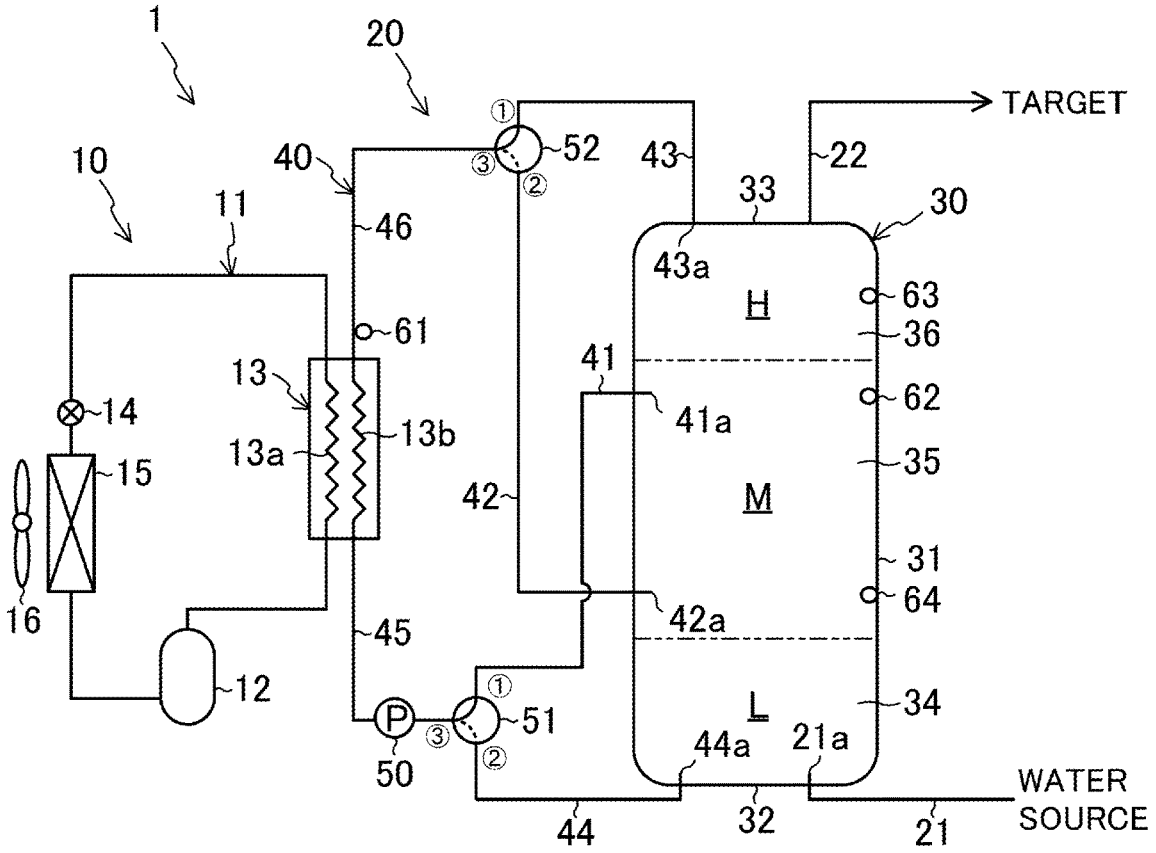
FIG. 1 is a piping system diagram illustrating a general configuration of a hot water supply unit according to an embodiment.

As illustrated in FIG. 1, the hot water supply unit (1) includes a heat source apparatus (10), the hot water supply apparatus (20), and a controller (100).

<Heat Source Apparatus>

The heat source apparatus (10) is a heat source for producing hot water. The heat source apparatus (10) is a heat pump heat source unit. The heat source apparatus (10) includes a refrigerant circuit (11). The refrigerant circuit (11) of the heat source apparatus (10) is filled with a refrigerant. Examples of the refrigerant to be used include a fluorocarbon refrigerant and a natural refrigerant, such as propane. The refrigerant circulates in the refrigerant circuit (11), thereby performing a vapor compression refrigeration cycle. Strictly, the refrigerant circuit (11) undergoes a so-called subcritical cycle in which the pressure of the high-pressure refrigerant is lower than the critical pressure.

The refrigerant circuit (11) includes a compressor (12), a water heat exchanger (13), an expansion valve (14), and an air heat exchanger (15).

The compressor (12) sucks and compresses a low-pressure refrigerant. The compressor (12) discharges the refrigerant compressed to high pressure.

The water heat exchanger (13) is a heating section that heats water. The water heat exchanger (13) is shared by the heat source apparatus (10) and the hot water supply apparatus (20). The water heat exchanger (13) has a refrigerant channel (13*a*) and a water channel (13*b*). The water heat exchanger (13) enables heat exchange between the refrigerant flowing through the refrigerant channel (13*a*) and the water flowing through the water channel (13*b*). The water heat exchanger (13) constitutes a radiator (condenser) that allows the refrigerant to dissipate heat.

The expansion valve (14) constitutes a decompression mechanism that decompresses the refrigerant. The expansion valve (14) decompresses the high-pressure refrigerant to low pressure. The expansion valve (14) is constituted of an electronic expansion valve, for example.

The air heat exchanger (15) enables heat exchange between the air and the refrigerant. The air heat exchanger (15) is placed outside a room. An outdoor fan (16) is installed near the air heat exchanger (15). The air transferred by the outdoor fan (16) passes through the air heat exchanger (15). In the air heat exchanger (15), the refrigerant absorbs heat from outdoor air and evaporates. The air heat exchanger (15) constitutes an evaporator.

<General Configuration of Hot Water Supply Apparatus>

The hot water supply apparatus (20) includes the water heat exchanger (13) described above and the tank (30) for storing the water heated by the water heat exchanger (13). The hot water supply apparatus (20) includes a water supply path (21) for sending water from a water source to the tank (30), a heating channel (40) for heating the water, and a supply path (22) for supplying the water in the tank (30) to a target.

<Tank>

The tank (30) is a hollow container. The tank (30) is formed in a vertically long cylindrical shape. The tank (30) has a cylindrical barrel (31), a bottom portion (32) closing a lower end of the barrel (31), and a top portion (33) closing an upper end of the barrel (31). A reservoir for storing water is formed in the tank (30). Specifically, a lower reservoir (34), an intermediate reservoir (35), and an upper reservoir (36) arranged sequentially from the bottom portion (32) toward the top portion (33) are formed in the tank (30). The upper reservoir (36) is located in an upper portion of the tank (30). The lower reservoir (34) is located in a lower portion of the tank (30). The intermediate reservoir (35) is located between the lower reservoir (34) and the upper reservoir (36).

The hot water supply apparatus (20) is configured to form a low-temperature layer (L), a medium-temperature layer (M), and a high-temperature layer (H) from the lower end to the upper end of the tank (30). In principle, the low-temperature layer (L) is located in the lower reservoir (34); the medium-temperature layer (M) is located in the intermediate reservoir (35); and the high-temperature layer (H) is located in the upper reservoir (36). The low-temperature layer (L), the medium-temperature layer (M), and the high-temperature layer (H) are not formed by natural convection of the heat in the tank (30), but are formed actively by the hot water supply apparatus (20) heating water.

The high-temperature layer (H), the medium-temperature layer (M), and the low-temperature layer (L) store water with different temperatures. The water in the high-temperature layer (H) (referred to also as "high-temperature water") has a temperature of, for example, about 60° C. The water in the medium-temperature layer (M) (referred to also as "medium-temperature water") has a temperature of, for example, about 40° C. The water in the low-temperature layer (L) (referred to also as "low-temperature water") has a temperature of, for example, about 10° C. The state in which the low-temperature layer (L), the medium-temperature layer (M), and the high-temperature layer (H) are formed in the tank (30) is called a first hot water storage state.

<Water Supply Path>

The water supply path (21) supplies water from a water source to the tank (30). The inlet of the water supply path (21) communicates with the water source. The water supply path (21) has an outflow port (21*a*) open to the lower reservoir (34).

<Heating Channel>

The heating channel (40) includes a plurality of pipes, a pump (50), and a channel switching mechanisms (51, 52).

The pipes include a first pipe (41), a second pipe (42), a third pipe (43), a fourth pipe (44), a first relay pipe (45), and a second relay pipe (46). The channel switching mechanism includes a first three-way valve (51) and a second three-way valve (52). Each of the first and second three-way valves (51) and (52) has first to third ports.

The first pipe (41) corresponds to the "first channel" according to the present disclosure. The first pipe (41) constitutes a channel for sending water in the medium-temperature layer (M) to the water heat exchanger (13) in the first hot water storage state of the tank (30). The first pipe (41) is connected to the barrel (31) of the tank (30). The first pipe (41) has an inflow port (41*a*) open to the intermediate reservoir (35). The inflow port (41*a*) of the first pipe (41) is located in an upper portion of the intermediate reservoir (35) which is closer to the high-temperature layer (H). The outlet end of the first pipe (41) is connected to the first port of the first three-way valve (51).

The second pipe (42) corresponds to the "second channel" according to the present disclosure. The second pipe (42) constitutes a channel for returning the water heated by the water heat exchanger (13) to the tank (30) in the first hot water storage state of the tank (30). The second pipe (42) is connected to the barrel (31) of the tank (30). The second pipe (42) has an outflow port (42*a*) located at a lower position than the inflow port (41*a*) of the first pipe (41). In this example, the outflow port (42*a*) of the second pipe (42) is open to the intermediate reservoir (35). The outflow port (42*a*) of the second pipe (42) is located in a lower portion of the intermediate reservoir (35) which is closer to the low-temperature layer (L). The inlet end of the second pipe (42) is connected to the second port of the second three-way valve (52).

The third pipe (43) corresponds to the "third channel" according to the present disclosure. The third pipe (43) constitutes a channel for returning the water (i.e., high-temperature water) heated by the water heat exchanger (13) to the high-temperature layer (H) of the tank (30) in the first hot water storage state of the tank (30). The third pipe (43) is connected to the top portion (33) of the tank (30). The third pipe (43) has an outflow port (43*a*) open to the upper reservoir (36). The outflow port (43*a*) of the third pipe (43) is located at a higher position than the inflow port (41*a*) of the first pipe (41). The inlet end of the third pipe (43) is connected to the first port of the second three-way valve (52).

The fourth pipe (44) corresponds to the "fourth channel" according to the present disclosure. The fourth pipe (44) constitutes a channel for sending water in the low-temperature layer (L) to the water heat exchanger (13) in the first hot water storage state of the tank (30). The fourth pipe (44) is connected to the bottom portion (32) of the tank (30). The fourth pipe (44) has an inflow port (44*a*) open to the lower reservoir (34). The inflow port (44*a*) of the fourth pipe (44) is located at a lower position than the outflow port (42*a*) of the second pipe (42). The outlet end of the fourth pipe (44) is connected to the second port of the first three-way valve (51).

The first relay pipe (45) is located upstream of the water heat exchanger (13). The inlet end of the first relay pipe (45) is connected to the third port of the first three-way valve (51). The outlet end of the first relay pipe (45) is connected to the inlet end of the water channel (13*b*) of the water heat exchanger (13).

The second relay pipe (46) is located downstream of the water heat exchanger (13). The inlet end of the second relay pipe (46) is connected to the outlet end of the water channel (13*b*) of the water heat exchanger (13). The outlet end of the second relay pipe (46) is connected to the third port of the second three-way valve (52).

The pump (50) transfers water in the heating channel (40). The pump (50) is located in the first relay pipe (45). The pump (50) is of a variable displacement type. The controller (100) controls the pump (50) to adjust the flow rate of the water flowing through the water heat exchanger (13). For example, the pump (50) may be located in the second relay pipe (46). For example, the pump (50) may be of a fixed displacement type.

The first three-way valve (51) switches between a first state indicated by a solid line in FIG. 1 and a second state indicated by a broken line in FIG. 1. The first three-way valve (51) in the first state makes the first and third ports communicate with each other and closes the second port. The first three-way valve (51) in the second state makes the second and third ports communicate with each other and closes the first port.

The second three-way valve (52) switches between a first state indicated by a solid line in FIG. 1 and a second state indicated by a broken line in FIG. 1. The second three-way valve (52) in the first state makes the first and third ports communicate with each other and closes the second port. The second three-way valve (52) in the second state makes the second and third ports communicate with each other and closes the first port.

Assume that Ht is the overall height of the tank (30), that h1 is the height from the bottom portion (32) of the tank (30) to the inflow port (41*a*) of the first pipe (41), and that h2 is the height from the bottom portion (32) of the tank (30) to the outflow port (42*a*) of the second pipe (42). The height h1 is longer than ½×Ht and shorter than ¾×Ht in a preferred embodiment. The height h2 is longer than ¼×Ht and shorter than ½×Ht in a preferred embodiment.

<Supply Path>

The supply path (22) constitutes a channel for sending the water in the high-temperature layer (H) of the tank (30) to the target. For example, the supply path (22) may include a channel for supplying the water in the medium-temperature layer (M) in the tank (30) to the target in addition to the water in the high-temperature layer (H) in the tank (30). For example, the supply path (22) may mix the water in the high-temperature layer (H) and the water in the medium-temperature layer (M) at a predetermined ratio and supply the mixed water to the target.

<Sensor>

Figure 2:
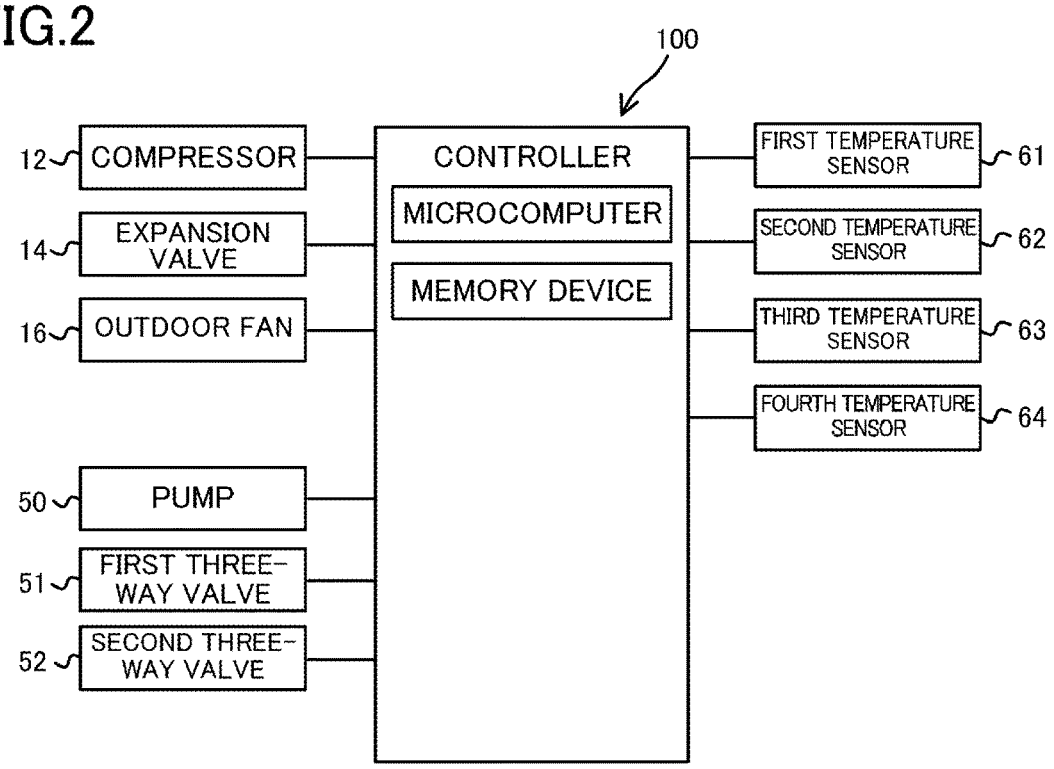
FIG. 2 is a block diagram illustrating a controller and devices connected to the controller.

As illustrated in FIGS. 1 and 2, the hot water supply apparatus (20) includes a first temperature sensor (61), a second temperature sensor (62), a third temperature sensor (63), and a fourth temperature sensor (64). The first temperature sensor (61) is located in the second relay pipe (46). The first temperature sensor (61) detects the temperature of the water flowing out of the water heat exchanger (13) in the heating channel (40). The second temperature sensor (62) detects the temperature of the water in an upper area of the intermediate reservoir (35) of the tank (30). The second temperature sensor (62) is substantially at the same height as the inflow port (41*a*) of the first pipe (41). The third temperature sensor (63) detects the temperature of the water in the upper reservoir (36) of the tank (30). The fourth temperature sensor (64) detects the temperature of the water in a lower area of the intermediate reservoir (35) of the tank (30). The fourth temperature sensor (64) is substantially at the same height as the outflow port (42*a*) of the second pipe (42).

<Controller>

As illustrated in FIG. 2, the controller (100) serving as a control unit includes a microcomputer and a memory device (specifically, a semiconductor memory) that stores software for operating the microcomputer.

The controller (100) controls the heat source apparatus (10) and the hot water supply apparatus (20). Specifically, the controller (100) controls the compressor (12), the expansion valve (14), and the outdoor fan (16). The controller (100) controls the pump (50), the first three-way valve (51), and the second three-way valve (52).

The controller (100) receives the temperatures detected by the first temperature sensor (61), the second temperature sensor (62), the third temperature sensor (63), and the fourth temperature sensor (64). The controller (100) controls the heat source apparatus (10) and the hot water supply apparatus (20) based on these detected temperatures.

In the first hot water storage state of the tank (30), the controller (100) executes first, second, third, and fourth operations.

Operation

An operation of the hot water supply unit (1) will be described. In the drawings, the flows of the refrigerant and water is indicated by broken arrows.

<Operation of Heat Source Apparatus>

When the water heat exchanger (13) heats water in the hot water supply unit (1), the heat source apparatus (10) performs the following operation.

When the heat source apparatus (10) is in operation, the controller (100) operates the compressor (12) and the outdoor fan (16), and opens the expansion valve (14) at a predetermined opening degree. The refrigerant circuit (11) performs a refrigeration cycle in which the water heat exchanger (13) functions as a radiator (condenser) and the air heat exchanger (15) functions as an evaporator.

The refrigerant discharged from the compressor (12) flows through the refrigerant channel (13*a*) of the water heat exchanger (13). In the water heat exchanger (13), the refrigerant in the refrigerant channel (13*a*) dissipates heat to the refrigerant in the water channel (13*b*). The refrigerant that has dissipated heat in the water heat exchanger (13) is decompressed by the expansion valve (14), and then flows through the air heat exchanger (15). In the air heat exchanger (15), the refrigerant absorbs heat from outdoor air and evaporates. The evaporated refrigerant is sucked into the compressor (12).

Example Operation Leading to First Hot Water Storage State

Next, an example operation of the hot water supply apparatus (20) from a state (i.e., a second hot water storage state) where only the low-temperature layer (L) is formed in the tank (30) to the first hot water storage state will be described.

[First Preparation Operation]

In the tank (30) in the second hot water storage state, the temperatures detected by the second and third temperature sensors (62) and (63) are lower than a first set temperature. Here, the first set temperature corresponds to the temperature of the medium-temperature water (e.g., 40° C.). In this case, the hot water supply apparatus (20) performs a first preparation operation.

Figure 3:
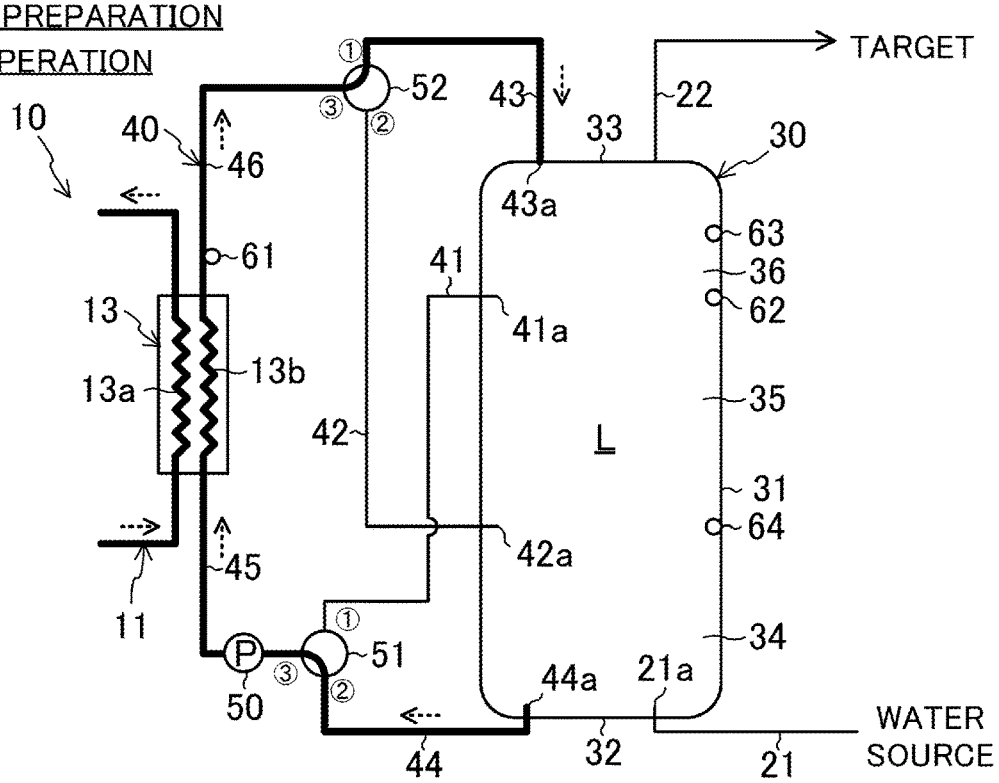
FIG. 3 is a schematic piping system diagram of the hot water supply apparatus and illustrates a first preparation operation.

In the first preparation operation shown in FIG. 3, the controller (100) operates the pump (50), sets the first three-way valve (51) to the second state, and sets the second three-way valve (52) to the first state. As a result, the low-temperature water in the lower reservoir (34) of the tank (30) flows through the fourth pipe (44) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the medium-temperature water. The medium-temperature water heated in the water heat exchanger (13) flows through the second relay pipe (46) and the third pipe (43) and returns to the upper reservoir (36). Continuous first preparation operation makes the inside of the tank (30) in a state (i.e., a third hot water storage state shown in FIG. 4) in which the low-temperature layer (L) and the medium-temperature layer (M) are formed.

[Second Preparation Operation]

In the tank (30) in third hot water storage state, the temperature detected by the second temperature sensor (62) is higher than or equal to the first set temperature, and the temperature detected by the third temperature sensor (63) is lower than a second set temperature. Here, the second set temperature corresponds to the temperature of the high-temperature water (e.g., 60° C.). In this case, the hot water supply apparatus (20) performs a second preparation operation.

Figure 4:
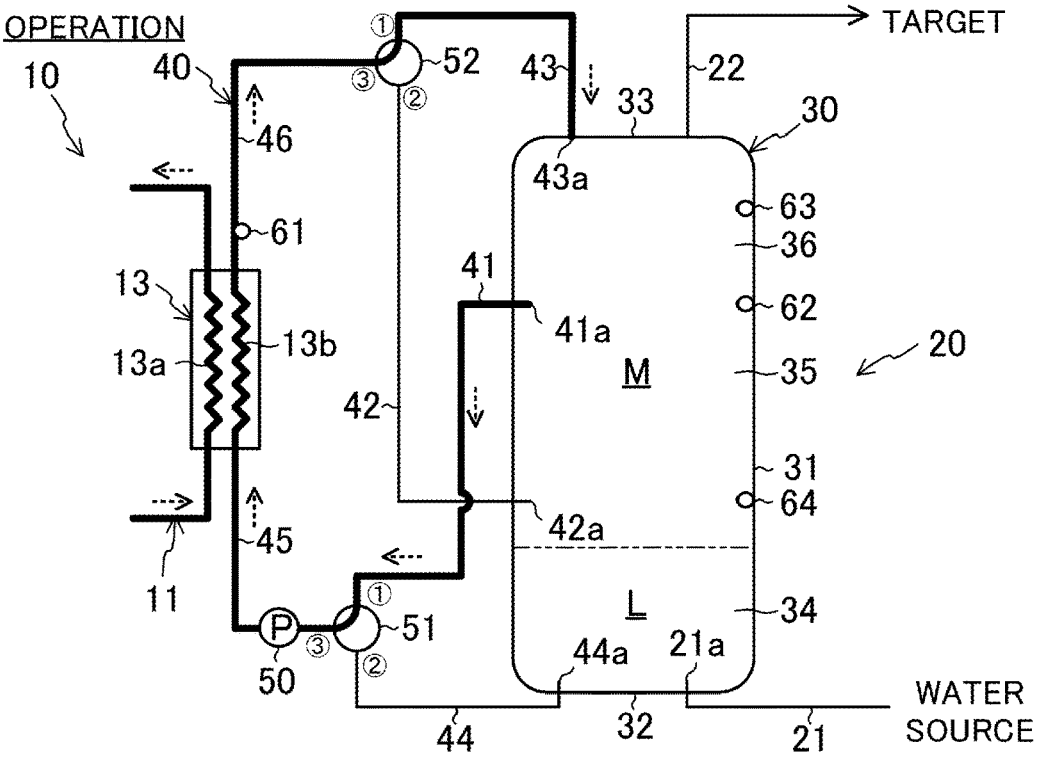
FIG. 4 is a schematic piping system diagram of the hot water supply apparatus and illustrates a second preparation operation.

In the second preparation operation shown in FIG. 4, the controller (100) operates the pump (50), sets the first three-way valve (51) to the first state, and sets the second three-way valve (52) to the first state. As a result, the medium-temperature water in the intermediate reservoir (35) of the tank (30) flows through the first pipe (41) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the high-temperature water. The high-temperature water heated in the water heat exchanger (13) flows through the second relay pipe (46) and the third pipe (43) and returns to the upper reservoir (36). The second preparation operation makes the inside of the tank (30) in the state (i.e., the first hot water storage state shown in FIG. 1) in which the low-temperature layer (L), the medium-temperature layer (M), and the high-temperature layer (H) are formed.

Operation in Third Hot Water Storage State

Next, four operations executed in the third hot water storage state of the tank (30) will be described. The hot water supply apparatus (20) in operation switches among first, second, third, and fourth operations.

[First Operation]

Figure 5:
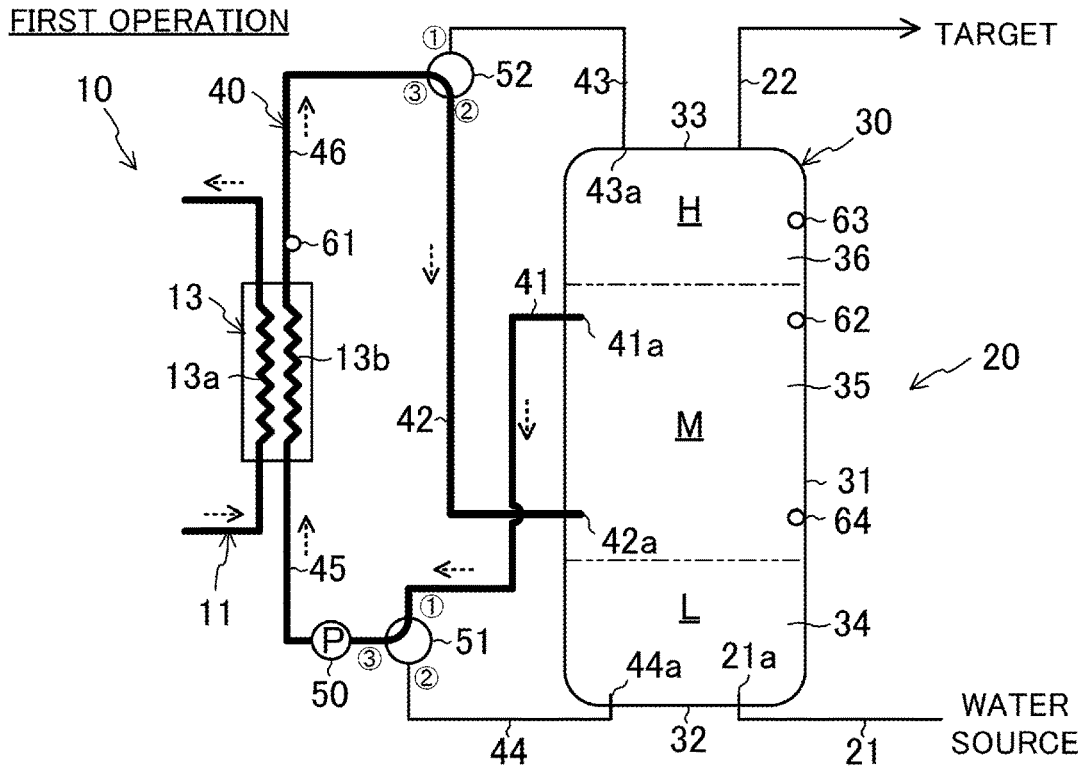
FIG. 5 is a schematic piping system diagram of the hot water supply apparatus and illustrates a first operation.

The first operation shown in FIG. 5 is heating the medium-temperature water in the medium-temperature layer (M) and returning the heated water to the medium-temperature layer (M) of the tank (30).

In the first operation, the controller (100) operates the pump (50), sets the first three-way valve (51) to the first state, and sets the second three-way valve (52) to the second state. As a result, the medium-temperature water in the intermediate reservoir (35) of the tank (30) flows through the first pipe (41) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the medium-temperature water or a predetermined temperature between the temperatures of the medium-temperature water and high-temperature water. The water heated in the water heat exchanger (13) flows through the second relay pipe (46) and the second pipe (42) and returns to the intermediate reservoir (35). This flow raises the temperature of the water in the medium-temperature layer (M) and makes it possible to maintain the temperature of the medium-temperature layer (M) continuously.

In the first operation, there is a relatively small difference in the water temperature between the inlet and the outlet of the water channel (13*b*) of the water heat exchanger (13). Accordingly, the water heat exchanger (13) can heat the water sufficiently even when the amount of circulation is increased in the heating channel (40). The temperature of the medium-temperature water in the medium-temperature layer (M) can thus be increased quickly.

In the first operation, the water heated by the water heat exchanger (13) returns from the outflow port (42*a*) of the second pipe (42) to the tank (30). If the outflow port (42*a*) of the second pipe (42) is relatively close to the high-temperature layer (H), the water returning from the second pipe (42) stirs the water in the high-temperature layer (H). This problem is significant particularly in the first operation which causes a larger amount of circulation in the heating channel (40), that is, a higher flow rate of water returning from the second pipe (42).

By contrast, in this embodiment, the outflow port (42*a*) of the second pipe (42) is located at a lower position than the inflow port (41*a*) of the first pipe (41) and relatively far from the high-temperature layer (H). This reduces the stirring and deformation of the high-temperature layer (H) by the water returning from the second pipe (42). The low-temperature layer (L), the medium-temperature layer (M), and the high-temperature layer (H) can thus be stable.

[Second Operation]

Figure 6:
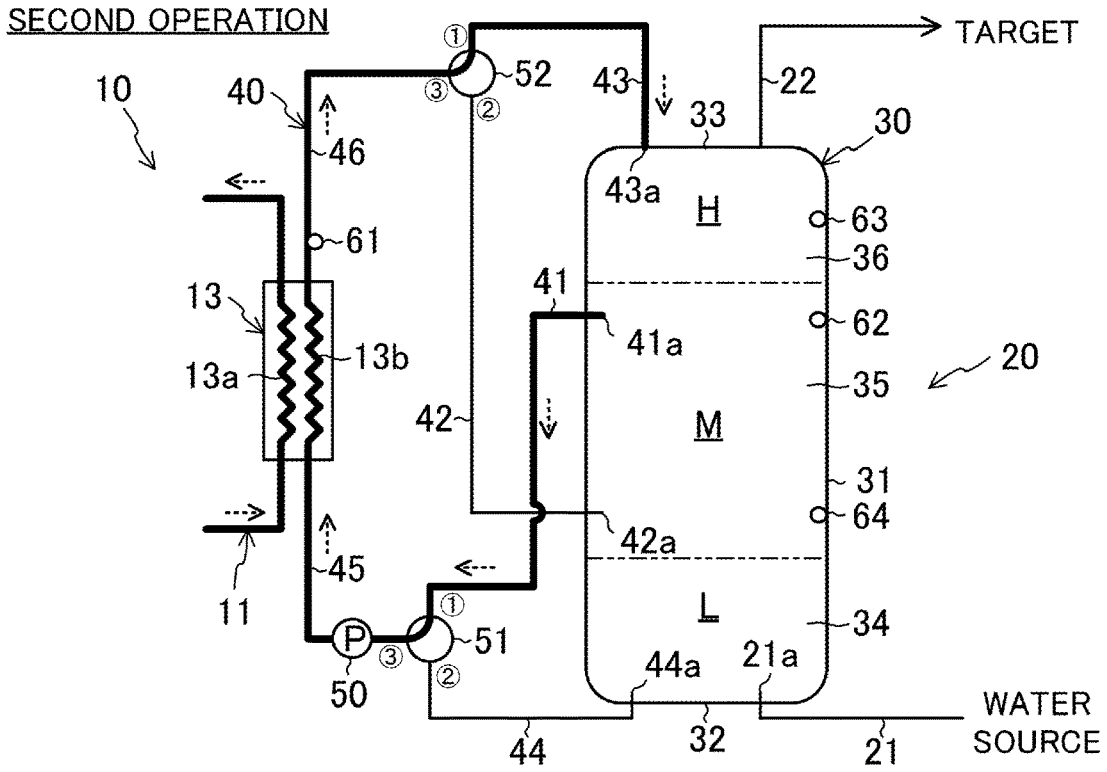
FIG. 6 is a schematic piping system diagram of the hot water supply apparatus and illustrates a second operation.

The second operation shown in FIG. 6 is heating the medium-temperature water in the medium-temperature layer (M) to high-temperature water and returning the high-temperature water to the high-temperature layer (H) of the tank (30).

In the second operation, the controller (100) operates the pump (50), sets the first three-way valve (51) to the first state, and sets the second three-way valve (52) to the first state. As a result, the medium-temperature water in the intermediate reservoir (35) of the tank (30) flows through the first pipe (41) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the high-temperature water. The water heated in the water heat exchanger (13) flows through the second relay pipe (46) and the third pipe (43)

and returns to the upper reservoir (36). The amount of the high-temperature water in the high-temperature layer (H) can thus be increased.

In the second operation, the medium-temperature water in the medium-temperature layer (M) near the high-temperature layer (H) flows into the first pipe (41). Relatively high-temperature water of the medium-temperature water in the medium-temperature layer (M) is thus sent to the water heat exchanger (13). As a result, there is a small difference in the water temperature between the inlet and the outlet of the water channel (13*b*) of the water heat exchanger (13) in the second operation. Accordingly, the water heat exchanger (13) can heat the water sufficiently even when the amount of circulation is increased in the heating channel (40). The temperature of the high-temperature water in the high-temperature layer (H) can thus be increased quickly.

[Third Operation]

Figure 7:
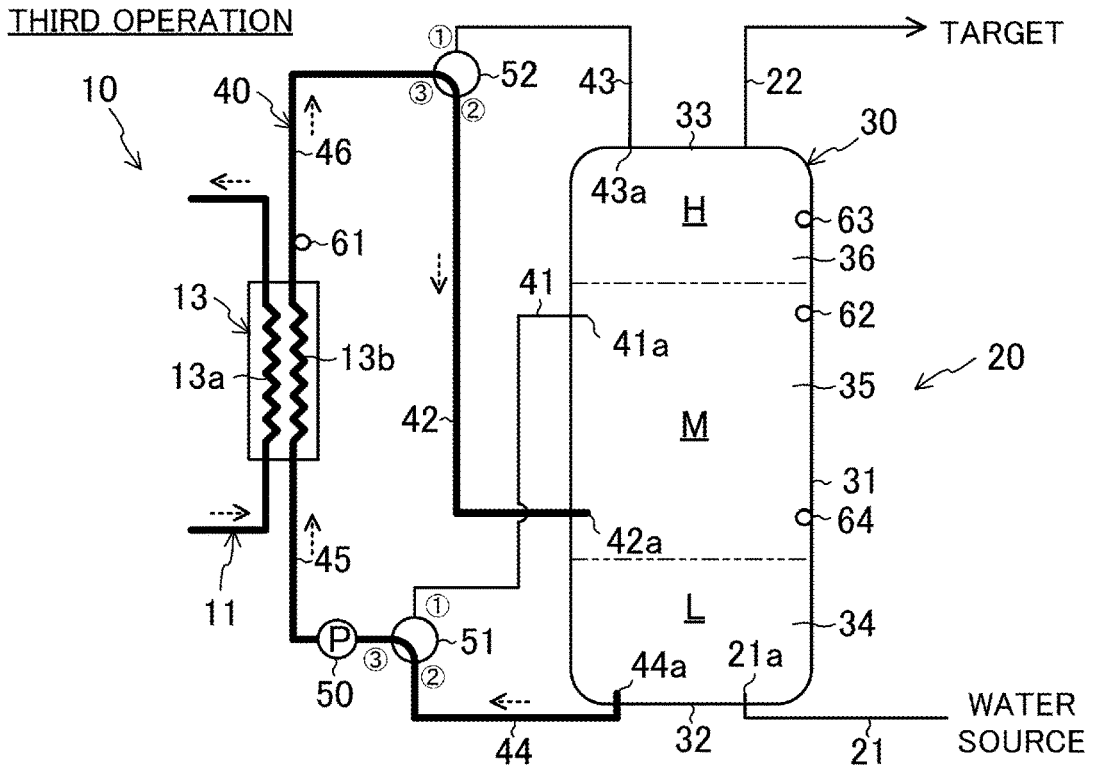
FIG. 7 is a schematic piping system diagram of the hot water supply apparatus and illustrates a third operation.
Figure 8:
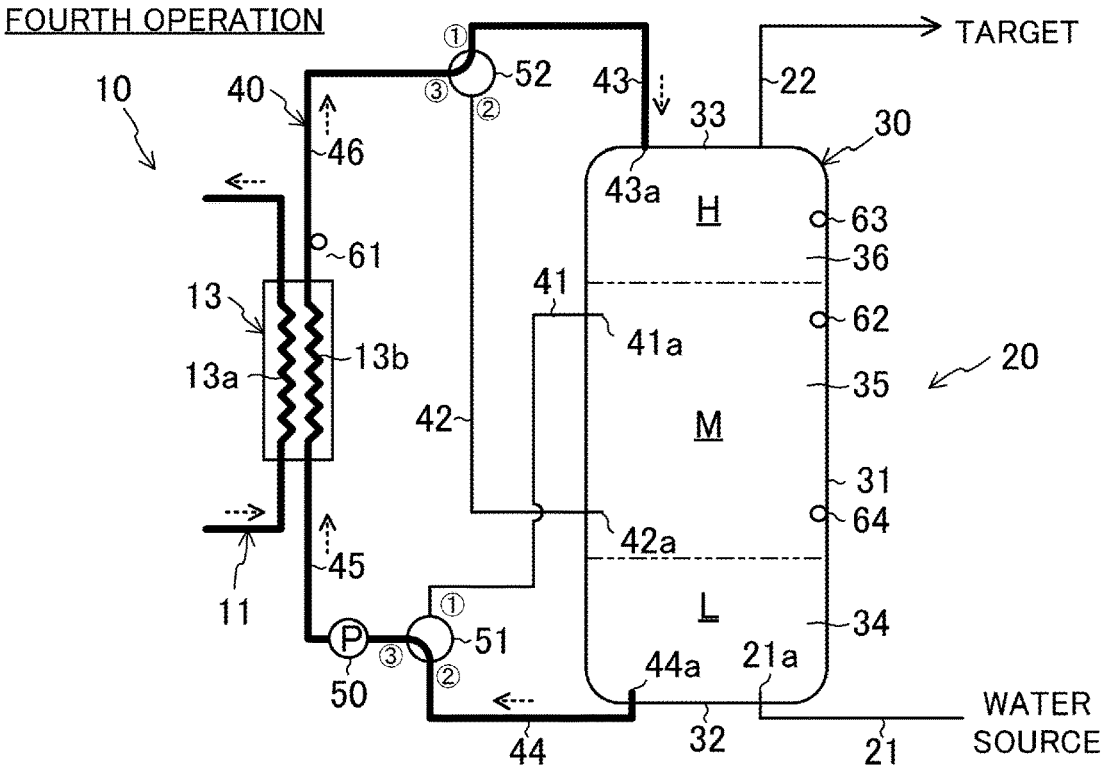
FIG. 8 is a schematic piping system diagram of the hot water supply apparatus and illustrates a fourth operation.

The third operation shown in FIG. 7 is heating the low-temperature water in the low-temperature layer (L) to medium-temperature water and returning the medium-temperature water to the medium-temperature layer (M) of the tank (30).

In the third operation, the controller (100) operates the pump (50), sets the first three-way valve (51) to the second state, and sets the second three-way valve (52) to the second state. As a result, the low-temperature water in the lower reservoir (34) of the tank (30) flows through the fourth pipe (44) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the medium-temperature water. The water heated in the water heat exchanger (13) flows through the second relay pipe (46) and the second pipe (42) and returns to the intermediate reservoir (35).

The outflow port (42*a*) of the second pipe (42) is relatively close to the low-temperature layer (L). Accordingly, if the temperature of the water returning from the second pipe (42) is lower than the temperature of water around the outflow port (42*a*) of the second pipe (42), the water returning from the second pipe (42) can raise the temperature of the low-temperature water in the low-temperature layer (L). On the other hand, if the temperature of the water returning from the second pipe (42) is higher than the temperature of water around the outflow port (42*a*) of the second pipe (42), heat of the water returning from the second pipe (42) moves upward by convection, which increases the amount of the medium-temperature water in the medium-temperature layer (M).

[Fourth Operation]

The fourth operation shown in FIG. 4 is heating the low-temperature water in the low-temperature layer (L) to high-temperature water and returning the high-temperature water to the high-temperature layer (H) of the tank (30).

In the fourth operation, the controller (100) operates the pump (50), sets the first three-way valve (51) to the second state, and sets the second three-way valve (52) to the first state. As a result, the low-temperature water in the lower reservoir (34) of the tank (30) flows through the fourth pipe (44) and the first relay pipe (45) and is heated by the water heat exchanger (13).

The controller (100) controls the capacity (the number of revolutions) of the compressor (12) so that the temperature detected by the first temperature sensor (61) becomes a temperature corresponding to the high-temperature water. The water heated in the water heat exchanger (13) flows through the second relay pipe (46) and the third pipe (43) and returns to the upper reservoir (36). The amount of the high-temperature water in the high-temperature layer (H) can thus be increased, while securing the medium-temperature water in the medium-temperature layer (M).

Advantages of Embodiment

In the first operation, the water in the medium-temperature layer (M) is sent through the first pipe (41) to the heating section (13), and the water heated by the heating section (13) returns through the second pipe (42) to the medium-temperature layer (M). The temperature of the medium-temperature water in the medium-temperature layer (M) can thus be increased.

In the first operation, it is possible to increase the amount of circulation in the heating channel (40) since there is a small difference in the water temperature between the inlet and the outlet of the water heat exchanger (13). The temperature of the medium-temperature water in the medium-temperature layer (M) can thus be increased quickly.

The outflow port (42*a*) of the second pipe (42) is located at a lower position than the inflow port (41*a*) of the first pipe (41). It is therefore possible to reduce the stirring of the high-temperature layer (H) by the water returning from the second pipe (42). The first hot water storage state of the tank (30) can thus be maintained.

In the second operation, the medium-temperature water around the inflow port (41*a*) of the first pipe (41) with a relatively high temperature is sent through the first pipe (41) to the heating section (13), and the water heated by the heating section (13) returns through the third pipe (43) to the high-temperature layer (H). There is thus a small difference in the water temperature between the inlet and the outlet of the water heat exchanger (13), and it is possible to increase the amount of circulation in the heating channel (40). The high-temperature water in the high-temperature layer (H) can thus be generated quickly.

In the third operation, the low-temperature water is heated by the heating section (13) and returned from the second pipe (42) to the tank (30). Accordingly, the heated medium-temperature water can be returned to a portion closer to the low-temperature layer (L). It is therefore possible to increase the amount of heat of the medium-temperature layer (M) or the low-temperature layer (L) in accordance with the temperature of the heated water.

In the fourth operation, the low-temperature water is heated to high-temperature water by the heating section (13), and the high-temperature water returns to the high-temperature layer (H). It is therefore possible to generate the high-temperature water in the high-temperature layer (H) without consuming the medium-temperature water in the medium-temperature layer (M).

The control unit (100) switches among the first, second, third, and fourth operations described above. Accordingly, the inside of the tank (30) can be kept in an optimum storage state of hot water in accordance with the hot water supply load, the operating conditions, or other factors.

Variations of Embodiment

The foregoing embodiment may be modified as follows.

<First Variation>

Figure 9:
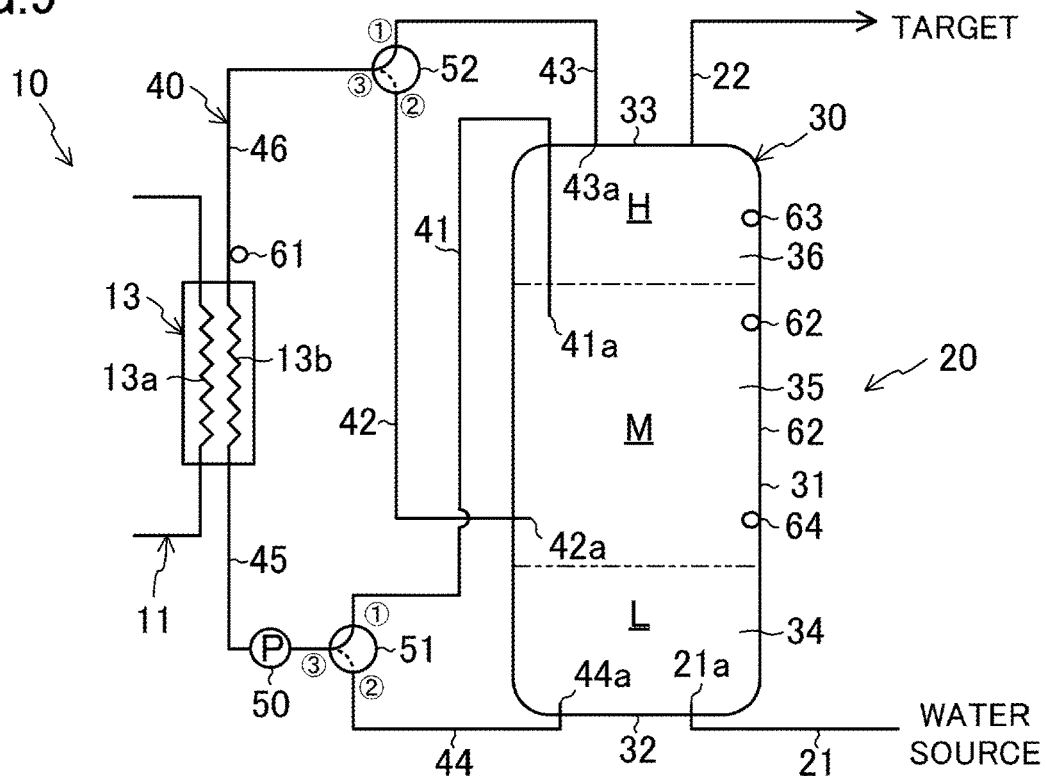
FIG. 9 is a schematic piping system diagram of a hot water supply apparatus according to a first variation.

In a first variation shown in FIG. 9, the first pipe (41) passes through the top portion (33) of the tank (30) and extends downward. The inflow port (41*a*) of the first pipe (41) is open to the intermediate reservoir (35), while facing downward. The inflow port (41*a*) of the first pipe (41) is at the same height as in the first embodiment described above.

<Second Variation>

Figure 10:
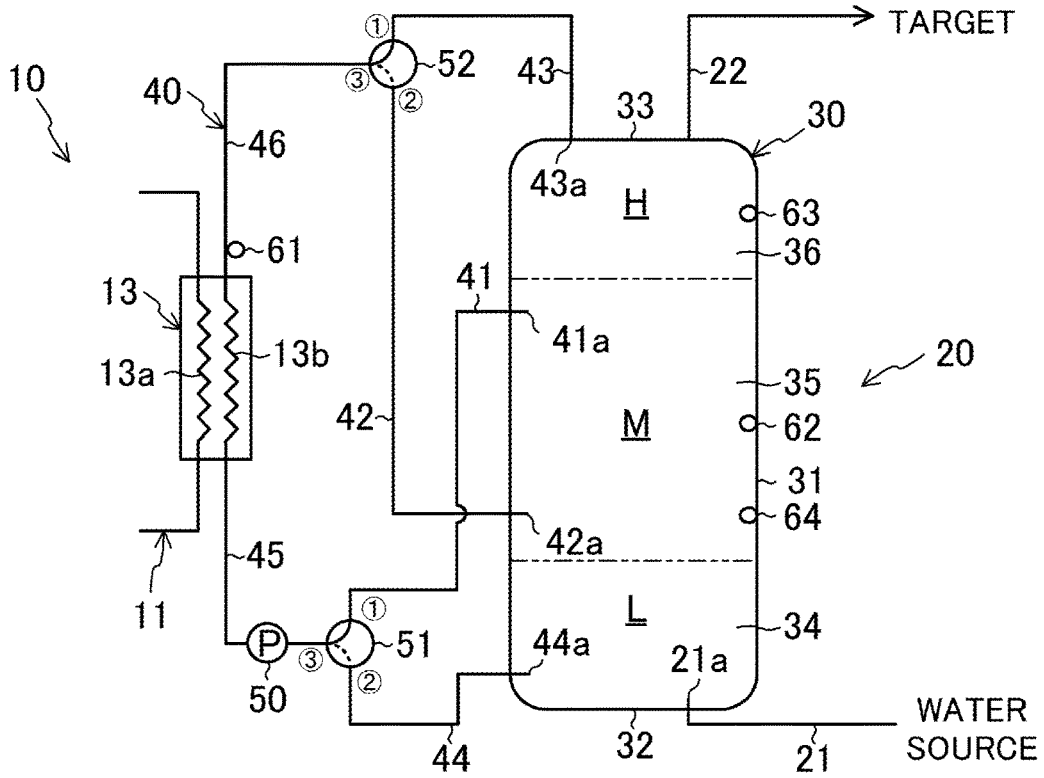
FIG. 10 is a schematic piping system diagram of a hot water supply apparatus according to a second variation.

In a second variation shown in FIG. 10, the fourth pipe (44) passes through the barrel (31) of the tank (30) and extends in the radial direction of the tank (30). The inflow port (44*a*) of the fourth pipe (44) is open to the lower reservoir (34), while facing laterally. The inflow port (44*a*) of the fourth pipe (44) is located at a lower position than the inflow port (41*a*) of the first pipe (41) and the outflow port (42*a*) of the second pipe (42).

<Third Variation>

Figure 11:
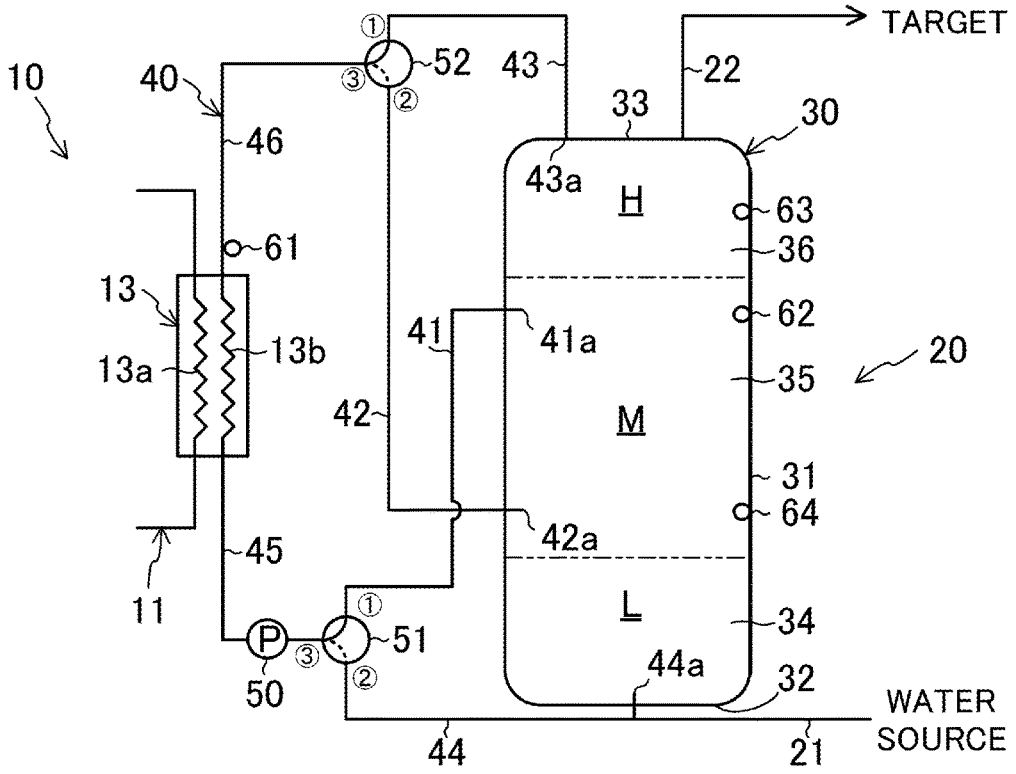
FIG. 11 is a schematic piping system diagram of a hot water supply apparatus according to a third variation.

In a third variation shown in FIG. 11, the water supply path (21) and the fourth pipe (44) are connected to each other. Specifically, the outlet end of the water supply path (21) is connected to an intermediate portion of the fourth pipe (44). This configuration allows water to be sent to the tank (30) from the water source through the water supply path (21) and the fourth pipe (44). In the third and fourth operations, water from the water source can be sent to the heating section (13) through the water supply path (21) and the fourth pipe (44).

<Fourth Variation>

Figure 12:
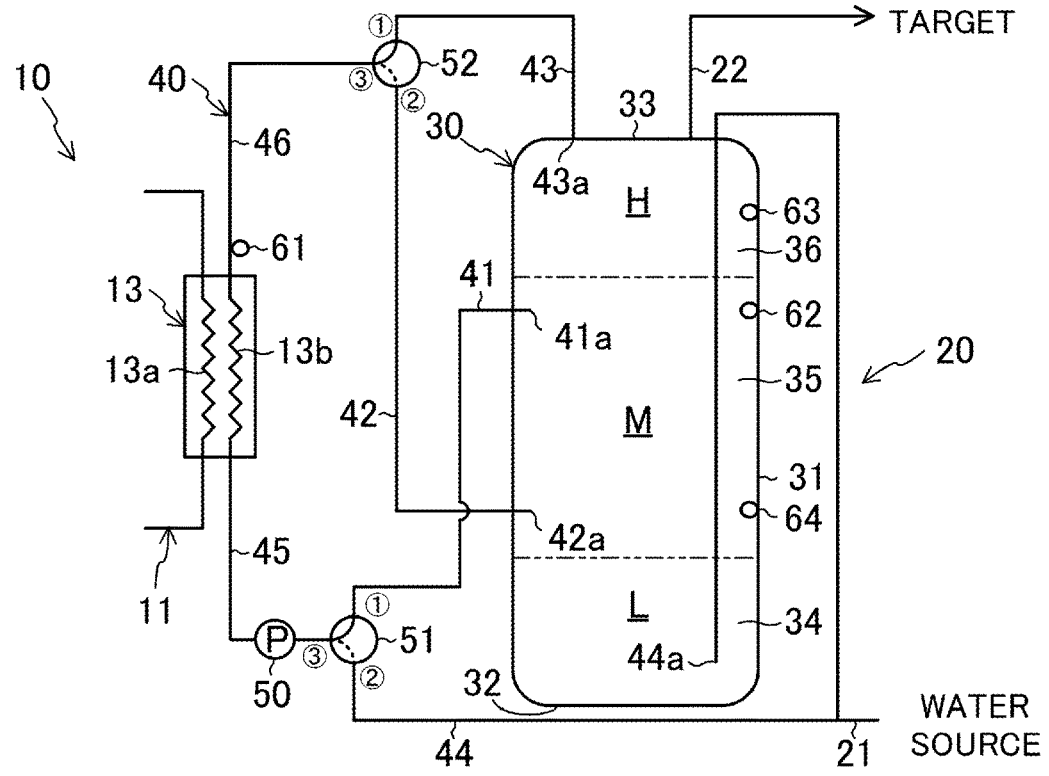
FIG. 12 is a schematic piping system diagram of a hot water supply apparatus according to a fourth variation.

In a fourth variation shown in FIG. 12, the fourth pipe (44) passes through the top portion (33) of the tank (30) and extends downward. The outlet end of the water supply path (21) is open to the lower reservoir (34), while facing downward. The inflow port (44*a*) of the fourth pipe (44) is located at a lower position than the inflow port (41*a*) of the first pipe (41) and the outflow port (42*a*) of the second pipe (42). The outlet end of the water supply path (21) is connected to an intermediate portion of the fourth pipe (44).

Similarly to the third variation, this configuration allows water to be sent to the tank (30) from the water source through the water supply path (21) and the fourth pipe (44). In the third and fourth operations, water from the water source can be sent to the heating section (13) through the water supply path (21) and the fourth pipe (44).

This configuration requires no pipe connected to the bottom portion (32) of the tank (30), which allows more flexible placement of the tank (30).

Other Embodiments

The above-described embodiment and variations may be modified in the following manner.

In the first hot water storage state, the hot water supply apparatus (20) only needs to execute at least the first operation among the first, second, third, and fourth operations. However, the hot water supply apparatus (20) executes the first, second, and third operations in a preferred embodiment.

For example, at least one of the first three-way valve (51) or the second three-way valve (52) may be constituted by two on-off valves.

For example, the heating section may use a heater or a heat source other than the refrigeration cycle.

For example, the heat source apparatus (10) may perform a supercritical cycle in which the high pressure of $CO_2$ used as a refrigerant is higher than or equal to the critical pressure thereof.

While the embodiment and variations thereof have been described above, it will be understood that various changes in form and details may be made without departing from the spirit and scope of the claims. The embodiment, the variation thereof, and the other embodiments may be combined and replaced with each other without deteriorating intended functions of the present disclosure. The expressions of "first," "second," "third," . . . described above are used to distinguish the words to which these expressions are given, and the number and order of the words are not limited.

INDUSTRIAL APPLICABILITY

The present disclosure is useful for a hot water supply apparatus.

EXPLANATION OF REFERENCES

13 Water Heat Exchanger (Heating Section)
20 Hot Water Supply Apparatus
30 Tank
41 First Pipe (First Channel)
41*a* Inflow Port
42 Second Pipe (Second Channel)
42*a* Outflow Port
43 Third Pipe (Third Channel)
44 Fourth Pipe (Fourth Channel)
100 Controller (Control Unit)

The invention claimed is:

1. A hot water supply apparatus including: a heating section configured to heat water; and a tank configured to store the water heated by the heating section, the hot water supply apparatus being configured to form a low-temperature layer (L), a medium-temperature layer (M), and a high-temperature layer (H) from a lower end to an upper end of the tank, the hot water supply apparatus comprising:

a first channel configured to send water in the medium-temperature layer (M) to the heating section; and a second channel configured to return the water heated by the heating section to the medium-temperature layer (M) of the tank, the second channel having an outflow port at a lower position than an inflow port of the first channel, the hot water supply apparatus further comprising a control unit configured to execute:

a preparation operation of controlling the hot water supply apparatus so as to create a first hot water storage state in which the low-temperature layer (L), the medium-temperature layer (M), and the high-temperature layer (H) are formed in the tank; and a first operation of causing the water in the medium-temperature layer (M) in the tank in the first hot water storage state to flow through the first channel and causing all the water having flowed from the medium-temperature layer (M) into the first channel to flow through the heating section and the second channel sequentially, after the preparation operation, wherein, in the first operation, the heating section heats water flowing through the first channel, the hot water supply apparatus further comprises:

a third channel configured to return the water heated by the heating section to the high-temperature layer (H) of the tank;

a fourth channel configured to send water in the low-temperature layer (L) or water from a water source to the heating section; and a plurality of sensors configured to sense the temperatures of the low-temperature layer (L), the medium-temperature layer (M), and the high-temperature layer (H) and the temperature of water exiting from the heating section, and the preparation operation includes:

a first preparation step, in response to a sensed temperature of water at the medium-temperature layer (M) being below a first set temperature, the controller is configured to cause water from the low-temperature layer (L) of the tank to flow to the heating section via the fourth channel and return via the third channel until the sensed temperature of water at the medium-temperature layer (M) is the first set temperature; and a second preparation step where, in response to a sensed temperature of water at the high-temperature layer (H) being below a second set temperature and a temperature of the water at the medium-temperature layer being at or above the first set temperature, the controller is configured to cause water from the medium-temperature layer (M) of the tank to flow to the heating section via the first channel and return via the third channel until the sensed temperature of the water at the high-temperature layer (H) is the second set temperature, the heating section heating the water from the medium-temperature layer (M) to a second temperature in the second preparation step, the second temperature being higher than the first temperature.

2. The hot water supply apparatus of claim 1, wherein the control unit is further configured to execute a second operation of causing the water in the medium-temperature layer (M) to flow through the first channel, the heating section, and the third channel sequentially.

3. The hot water supply apparatus of claim 1 wherein the control unit is further configured to execute a third operation of causing the water in the low-temperature layer (L) or the water from the water source to flow through the fourth channel, the heating section, and the second channel sequentially.

4. The hot water supply apparatus of claim 1, wherein the control unit is further configured to execute a second operation of causing the water in the medium-temperature layer (M) to flow through the first channel, the heating section, and the third channel sequentially, and a third operation of causing the water in the low-temperature layer (L) or the water from the water source to flow through the fourth channel, the heating section, and the second channel sequentially.

5. The hot water supply apparatus of claim 4, wherein the control unit executes a fourth operation of causing the water in the low-temperature layer (L) or the water from the water source to flow through the fourth channel, the heating section, and the third channel sequentially.

6. The hot water supply apparatus of claim 1, further comprising:

a sensor configured to sense a temperature of the water heated by the heating section before the water heated by the heating section is returned to the tank;

a compressor configured to pump water through the heating section; and a valve configured to switch flow of the water from the heating section to one of the second channel or the third channel, wherein the control unit configured to control the valve and the compressor such that compressor operates at a first rate such that water returning to the tank via the second channel has a first temperature and the compressor operates at a second rate such that water returned through the third channel has a second temperature different from the first temperature.

7. The hot water supply apparatus of claim 1, wherein the preparation operation of controlling the hot water supply apparatus includes creating the first hot water storage state in which a temperature of the low-temperature layer (L) is below the temperature of the medium-temperature layer (M), the temperature of the medium-temperature layer (M) corresponds to the first set temperature, and a temperature of the high-temperature layer (H) is higher than the first set temperature.

8. The hot water supply apparatus of claim 7, wherein the preparation operation of controlling the hot water supply apparatus includes creating the first hot water storage state in which the temperature of the high-temperature layer (H) corresponds to the second set temperature higher than the first set temperature.

* * * * *